US010876801B2

(12) United States Patent
Zhang et al.

(10) Patent No.: US 10,876,801 B2
(45) Date of Patent: Dec. 29, 2020

(54) HEAT-EXCHANGING PLATE, AND PLATE HEAT EXCHANGER USING SAME

(71) Applicant: Danfoss Micro Channel Heat Exchanger (Jiaxing) Co., Ltd., Zhejiang (CN)

(72) Inventors: Zhifeng Zhang, Zhejiang (CN); Wenjian Wei, Zhejiang (CN)

(73) Assignee: DANFOSS MICRO CHANNEL HEAT EXCHANGER (JIAXING) CO., LTD., Zhejiang (CN)

( * ) Notice: Subject to any disclaimer, the term of this patent is extended or adjusted under 35 U.S.C. 154(b) by 106 days.

(21) Appl. No.: 16/072,527

(22) PCT Filed: Jan. 6, 2017

(86) PCT No.: PCT/CN2017/070390
§ 371 (c)(1),
(2) Date: Jul. 25, 2018

(87) PCT Pub. No.: WO2017/133377
PCT Pub. Date: Aug. 10, 2017

(65) Prior Publication Data

US 2019/0033011 A1 Jan. 31, 2019

(30) Foreign Application Priority Data

Feb. 4, 2016 (CN) ..... 2016 1 0079790

(51) Int. Cl.
*F28F 3/04* (2006.01)
*F28D 9/00* (2006.01)
(Continued)

(52) U.S. Cl.
CPC ..... *F28F 3/044* (2013.01); *F28D 9/00* (2013.01); *F28D 9/0062* (2013.01); *F28F 3/025* (2013.01);
(Continued)

(58) Field of Classification Search
CPC . F28F 3/044; F28F 3/025; F28F 3/046; F28D 9/00; F28D 9/0062
See application file for complete search history.

(56) References Cited

U.S. PATENT DOCUMENTS 4,253,520 A 3/1981 Friedericy et al.
2013/0153184 A1* 6/2013 Rolt ..... F28F 3/046 165/166

FOREIGN PATENT DOCUMENTS

CN 1811322 A 8/2006
CN 101261057 A 9/2008
(Continued)

OTHER PUBLICATIONS

International Search Report for PCT Serial No. PCT/CN2017/070390 dated Apr. 5, 2017.
(Continued)

*Primary Examiner* — Jon T. Schermerhorn, Jr.
(74) *Attorney, Agent, or Firm* — McCormick, Paulding & Huber PLLC

(57) ABSTRACT

A heat-exchanging plate (20), and plate heat exchanger (100) using same. The heat-exchanging plate (20) comprises concave locations (22) and/or convex locations (23). In at least one partial region of the heat-exchanging plate (20), a transitional curved surface between at least two adjacent concave location (22) and/or convex location (23) is configured to be controllable.

9 Claims, 5 Drawing Sheets

(51) Int. Cl.
*F28F 3/02* (2006.01)
*F28F 27/02* (2006.01)

(52) U.S. Cl.
CPC ..... *F28F 3/046* (2013.01); *F28F 27/02* (2013.01); *F28F 2250/102* (2013.01)

(56) References Cited

FOREIGN PATENT DOCUMENTS

| | | | |
|---|---|---|---|
| CN | 100513968 | C | 7/2009 |
| CN | 104132576 | A | 11/2014 |
| CN | 104696983 | A | 6/2015 |
| CN | 204881286 | U | 12/2015 |
| CN | 205748079 | U | 11/2016 |
| CN | 205784791 | U | 12/2016 |
| DE | 1751146 | A1 | 2/1972 |
| DE | 2638005 | A1 | 3/1978 |
| EP | 2607831 | A1 | 6/2013 |
| JP | H08101000 | A | 4/1996 |
| JP | H09210495 | A | 8/1997 |
| JP | H11173771 | A | 7/1999 |
| JP | H11281283 | A | 10/1999 |
| JP | 2008116138 | A | 5/2008 |

OTHER PUBLICATIONS

Supplementary European Search Report for Serial No. 17746697 dated Aug. 26, 2019.

* cited by examiner

HEAT-EXCHANGING PLATE, AND PLATE HEAT EXCHANGER USING SAME

CROSS-REFERENCE TO RELATED APPLICATIONS

This application is a National Stage application of International Patent Application No. PCT/CN2017/070390, filed on Jan. 6, 2017, and claims the priority of Chinese patent application no. 201610079790.6 filed on Feb. 4, 2016, the entire contents of which are incorporated herein by reference.

TECHNICAL FIELD

The present invention relates to the technical fields of refrigeration and air conditioning, the petrochemical industry and district heat supply, etc., in particular to a plate heat exchanger used in these technical fields, and a heat exchange plate used by same.

BACKGROUND

In general, the magnitude of the pressure drop in a plate heat exchanger is directly related to the size of the flow cross section. Relative to a plate heat exchanger, in general, corrugation depth is a key parameter influencing pressure drop magnitude, but corrugation depth has a coupled relationship with other corrugation structure parameters, so cannot be adjusted independently. Moreover, there is a negative correlation between two sides of a plate heat exchanger.

In the prior art, once the distribution of dimples on a heat exchange plate has been defined, transitional curved surfaces among dimples are passively finalized in form; it is not possible to adjust pressure drop, liquid distribution and heat exchange efficiency as required. If it is desired to adjust the pressure drop, liquid distribution or heat exchange while retaining the original structural form, it is necessary to redesign and adjust the distribution of dimples, and this restricts design considerably. It may even result in a design being incapable of achieving the required pressure drop, liquid distribution and efficiency. Furthermore, existing structures and methods of design are unable to adjust an asymmetric ratio of two sides of a sheet of a heat exchange plate in a plate heat exchanger, or the asymmetric ratio is very small.

SUMMARY

The object of the present invention is to resolve at least one aspect of the abovementioned problems and shortcomings in the prior art.

In a dimple plate heat exchanger, the distribution of dimples on heat exchange plates has a decisive effect on the pressure drop, liquid distribution and efficiency of the heat exchanger, and there is limited space for changes to be made, so that some design targets are unachievable.

It has been found through analysis and study of sheets of heat exchange plates that a major factor influencing the liquid distribution, pressure drop and efficiency of a dimple heat exchanger is the minimum flow cross section of heat exchange units on the sheets, and it is possible to adjust liquid distribution, pressure drop and efficiency by controlling and adjusting the minimum flow cross section.

Although the present invention is described and explained in detail taking a dimple heat exchanger as an example, those skilled in the art will understand that the design concept thereof is not limited to the abovementioned dimple heat exchanger, and may be likewise used in protrusion and depression plate heat exchangers, for example. That is to say, the design concept of the present invention may be used in dimple plate heat exchangers or in various types of plate heat exchanger having a similar structure.

According to one aspect of the present invention, a heat exchange plate is provided, comprising depressions and/or protrusions; a transitional curved surface between at least two adjacent depressions and/or protrusions on an at least partial region of the heat exchange plate is configured to be restricted.

In one example, flow paths on two adjacent sides of an at least partial region of the heat exchange plate have different minimum flow cross section profiles and/or areas.

In one example, at least one of pressure drop, heat exchange performance and volume of an entire plate heat exchanger is/are adjusted by means of at least one of the following parameters of an at least partial region of the heat exchange plate:

- Ta: edge spacing between two adjacent protrusions or shortest distance between two adjacent protrusions on the heat exchange plate;
- Tb: edge spacing between two adjacent depressions or shortest distance between two adjacent depressions, wherein a distance connecting line of said Tb and a distance connecting line of said Ta intersect with each other in space;
- Ha: perpendicular distance between the highest point of the heat exchange plate and the lowest point of an upper surface of a depressed transitional curved line connected across Ta;
- Ha: perpendicular distance between the lowest point of the heat exchange plate and the highest point of a lower surface of a protruding transitional curved line connected across Tb;
- Wa: distance between two ends of the curved line corresponding to Ha;
- Wb: distance between two ends of the curved line corresponding to Hb;
- e: perpendicular distance between the depression and a high point of an upper surface of the heat exchange plate, or perpendicular distance between the protrusion and the lowest point of a lower surface of the heat exchange plate.

In one example, while keeping Ta and Tb of an at least partial region of the heat exchange plate unchanged, a minimum flow cross section on at least one side of the heat exchange plate is adjusted by adjusting Ha and Hb of the at least partial region, in order to adjust the pressure drop, heat exchange performance, volume and asymmetry of two sides of the heat exchange plate.

In one example, the operation of adjusting the parameters Ha and Hb comprises: decreasing the parameter Ha while increasing the parameter Hb; or increasing the parameter Ha while decreasing the parameter Hb.

In one example, the parameters satisfy the following relations:

$$Ha \approx \frac{Ta}{Ta+Tb} \times e, \quad Hb \approx \frac{Tb}{Ta+Tb} \times e.$$

According to another aspect of the present invention, a plate heat exchanger is provided, comprising multiple heat exchange plates stacked together, the heat exchange plates being heat exchange plates as described above, with a heat exchange channel being formed between two adjacent heat exchange plates after stacking.

In one example, the heat exchange channel between at least partial regions of the two adjacent heat exchange plates has a different cross section profile and/or area on two adjacent sides of either one of the two heat exchange plates.

In one example, the heat exchange channel between at least partial regions of the two adjacent heat exchange plates has a different minimum flow cross section profile and/or area on the two adjacent sides.

In one example, different fluids flow through flow paths on two surfaces of the same heat exchange plate in order to achieve heat exchange.

BRIEF DESCRIPTION OF THE DRAWINGS

These and/or other aspects and advantages of the present invention will become obvious and easy to understand through the following description of the preferred embodiments in conjunction with the accompanying drawings, wherein:

FIGS. 7*a*, 7*b*, 7*c* and 7*d* are a top view and cross sectional views along lines A2-A2, B2-B2 and C2-C2 respectively of a part of a first or upper heat exchange plate in FIG. 6.

DETAILED DESCRIPTION

The technical solution of the present invention is explained in further detail below by means of embodiments, in conjunction with the accompanying drawings. In this description, identical or similar drawing labels indicate identical or similar components. The following explanation of embodiments of the present invention with reference to the accompanying drawings is intended to explain the overall inventive concept of the present invention, and should not be interpreted as a limitation of the present invention.

Figure 1:
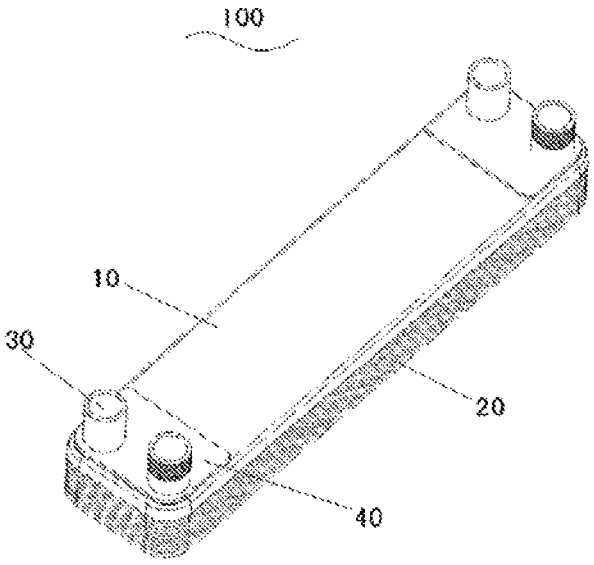
FIG. 1 is a three-dimensional view of a plate heat exchanger according to an embodiment of the present invention.

FIG. 1 shows a perspective view of a plate heat exchanger 100 according to an embodiment of the present invention. The plate heat exchanger 100 mainly comprises end plates 10 located on an upper side and a lower side, heat exchange plates 20 located between the two end plates 10, connection tubes 30 located at inlets and outlets of the plate heat exchanger 100, and reinforcing plates 40 disposed at the inlets and the outlets, etc.

Figure 2:
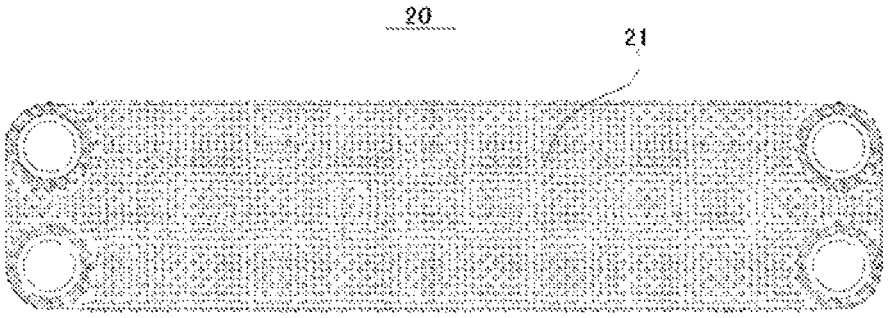
FIG. 2 is a top view of a heat exchange plate in FIG. 1.

Referring to FIG. 2, it can be seen that a main heat exchange unit of the heat exchange plate 20 is formed of some dimple units 21. When fluids flow past the heat exchange plate 20, cold and hot fluids located on two sides of the heat exchange plate 20 are separated by a sheet of the heat exchange plate 20, and exchange heat via the sheet of the heat exchange plate 20.

Figure 3A:
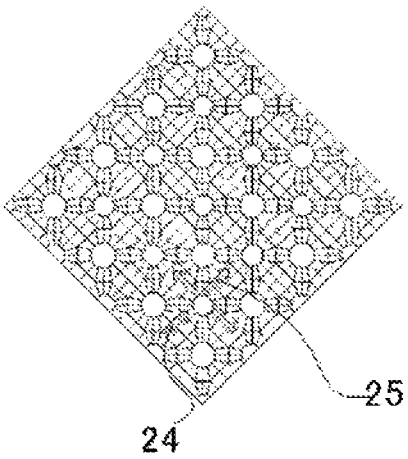
FIGS. 3*a*, 3*b* and 3*c* are a top view, a side view and a three-dimensional view respectively of a part of the heat exchange plate in FIG. 2.
Figure 3B:
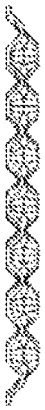
Figure 3C:
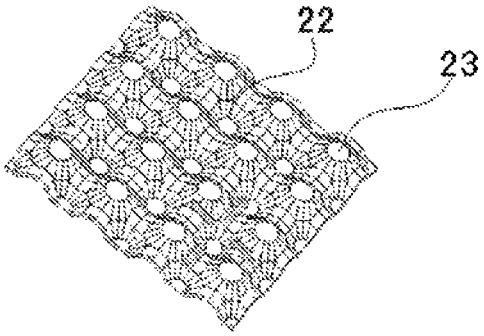

As shown in FIGS. 3*a*-3*c*, the heat exchange plate 20 comprises multiple depressions 22 and/or protrusions 23. The multiple depressions 22 and/or protrusions 23 form a heat exchange unit located on the heat exchange plate 20. It will be understood that the quantity of depressions 22 and/or protrusions 23 included in each heat exchange unit is not subject to any particular restriction; those skilled in the art can set a particular quantity thereof as required. In other words, multiple such heat exchange units are disposed on two sides of the sheet of the heat exchange plate 20.

In the present invention, a transitional curved surface between at least two adjacent depressions 22 and/or protrusions 23 on an at least partial region of the heat exchange plate 20 is configured to be restricted.

It must be explained here that the meaning of the statement "a transitional curved surface between adjacent depressions 22 and/or protrusions 23 is configured to be restricted" here signifies that the transitional curved surface can be controlled or adjusted as desired, and is not regular or uniform. As described in the background art section, once the distribution of dimples on a heat exchange plate has been defined, transitional curved surfaces among dimples are passively finalized in form; it is not possible to adjust pressure drop, liquid distribution and heat exchange efficiency as required. In comparison, in the present invention, in the case of a dimple plate heat exchanger or a plate heat exchanger of a similar structure, a transitional curved surface between adjacent depressions 22 and/or protrusions 23 can be adjusted as required; the fluid pressure drop at each side of the heat exchanger can be adjusted as required; the fluid volume at each side of the heat exchanger can be adjusted as required; and the flow cross section in each region of the heat exchanger can be adjusted as required in order to adjust the fluid distribution.

Figure 6:
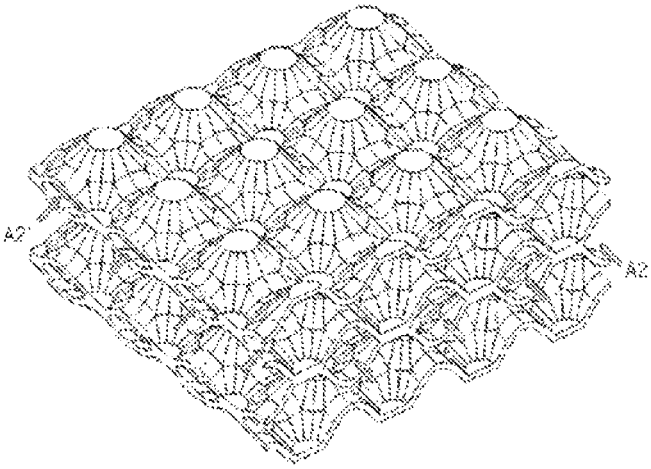
FIG. 6 is a three-dimensional schematic view of a part of a structure formed when four of the heat exchange plates shown in FIG. 2, after being adjusted, are stacked together to form heat exchange channels, according to an embodiment of the present invention, wherein the arrows in the drawing show the flow directions of fluids.

In one example, minimum flow cross sections A2 and A2' for different fluids on two adjacent sides of an at least partial region of the heat exchange plate 20 have different profiles and/or areas, e.g. see FIG. 6.

In one example of the present invention, at least one of pressure drop, heat exchange performance and volume of the entire plate heat exchanger 100 is/are adjusted by means of at least one of the following parameters of an at least partial region of the heat exchange plate 20:

Ta: edge spacing between two adjacent protrusions 23 or shortest distance between two adjacent protrusions 23 on the heat exchange plate 20;

Tb: edge spacing between two adjacent depressions 22 or shortest distance between two adjacent depressions 22, wherein a distance connecting line of said Tb and a distance connecting line of said Ta intersect with each other in space;

Ha: perpendicular distance between the highest point of the heat exchange plate 20 and the lowest point of an upper surface of a depressed transitional curved line connected across Ta;

Ha: perpendicular distance between the lowest point of the heat exchange plate 20 and the highest point of a lower surface of a protruding transitional curved line connected across Tb;

Wa: distance between two ends of the curved line corresponding to Ha;

Wb: distance between two ends of the curved line corresponding to Hb;

e: perpendicular distance between the depression and a high point of an upper surface of the heat exchange plate 20, or perpendicular distance between the protrusion and the lowest point of a lower surface of the heat exchange plate 20.

The two protrusions and the two depressions share one transitional curved surface.

While keeping Ta and Tb of an at least partial region of the heat exchange plate 20 unchanged, the minimum flow cross sections A2 and A2' of inflow ports on at least one side of the heat exchange unit are adjusted by adjusting Ha and Hb of the at least partial region, in order to adjust the pressure drop, heat exchange performance, volume and/or asymmetry of two sides of the heat exchange plate 20.

Figure 4:
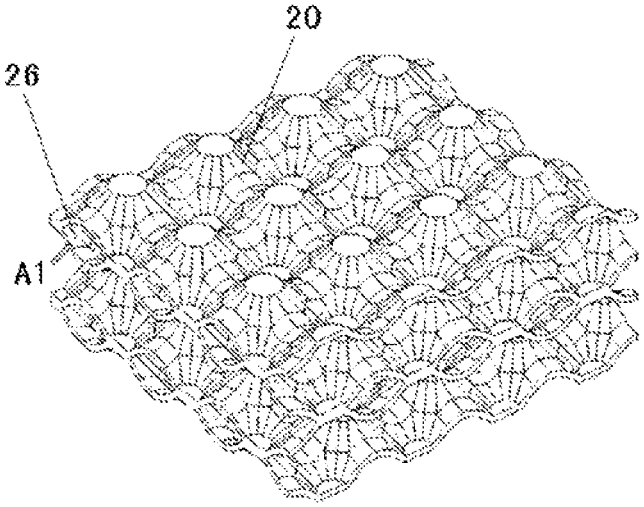
FIG. 4 is a three-dimensional schematic view of a part of a structure formed when four of the heat exchange plates shown in FIG. 2 are stacked together to form heat exchange channels.

As shown in FIG. 4, multiple said heat exchange plates 20 are stacked together to form the plate heat exchanger 100; after stacking, a heat exchange channel 26 is formed between two adjacent heat exchange plates 20. Adjacent heat exchange channels 26 are separated by the sheet of the heat exchange plate 20.

Figure 5B:
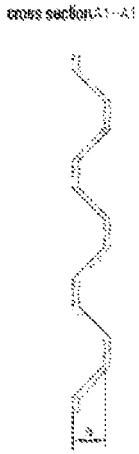
FIGS. 5*a*, 5*b*, 5*c* and 5*d* are a top view and cross sectional views along lines A1-A1, B1-B1 and C1-C1 respectively of a part of a first heat exchange plate in FIG. 4.
Figure 5A:
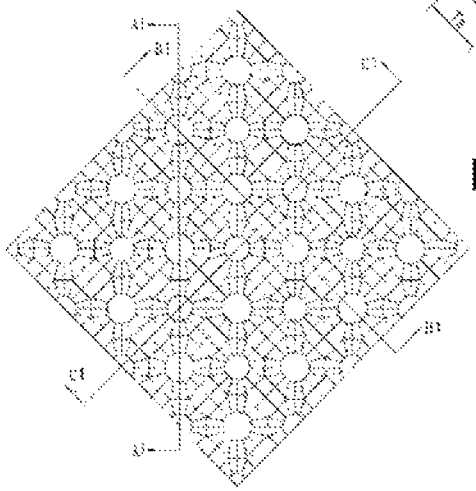
Figure 5C:
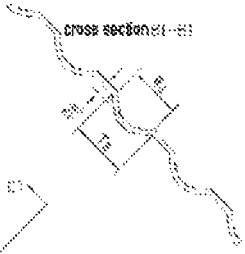
Figure 5D:
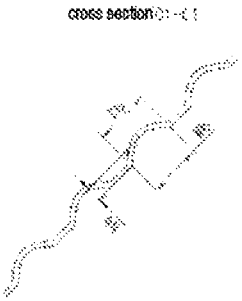

As shown in FIGS. 5*a*-5*d*, in the case of a sheet of a dimple heat exchange plate, once the sheet dimple depth, dimple spacings Ta and Tb, and the sheet thickness have been defined, then the parameters Wa and Wb shown in FIGS. 5*c* and 5*d* are also defined, and if the corresponding parameters ha and hb have also been defined according to a conventional method in the prior art, then a minimum flow cross section A1 shown in FIG. 4 has been restricted, so the pressure drop, heat exchange performance and volume of the sheet of the entire heat exchange plate 20 cannot be changed.

Taking the drawings in FIGS. 5*a*-5*d* as an example, if Ta=Tb, according to the principle of free shaping, then Wa=Wb, ha=hb, and a sheet that is symmetrical on two sides is naturally obtained; the height of the transitional curved surface ha=hb=e/2, and the result of such an arrangement is that once the design of the dimple structure has been completed, the pressure drop, heat exchange performance and volume of the two sides cannot be adjusted, and the degree of asymmetry of the two sides can likewise not be adjusted.

Figures 7A, 7B, 7D:
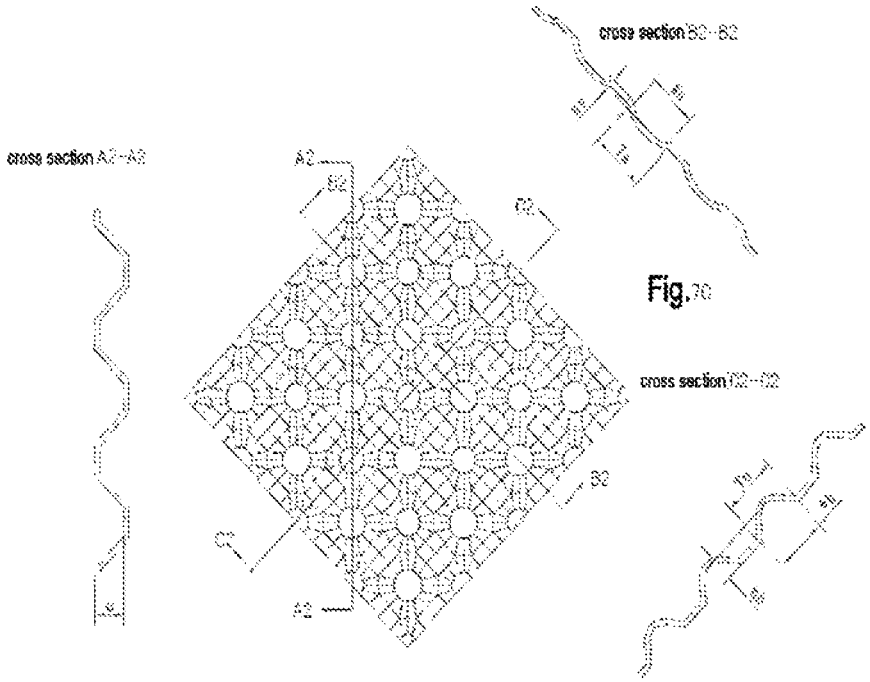

Taking FIGS. 6-7*d* as an example below, under the condition that the parameters Ta and Tb are not changed, the minimum flow cross section A2' can be freely adjusted within a certain range by adjusting the parameters ha and hb, in order to adjust the pressure drop, heat exchange performance, volume and asymmetry of the two sides. First of all, the case where the parameter ha is decreased while the parameter hb is increased is taken as an example, such that a minimum flow cross section of a flow path on this plate surface of the heat exchange plate shown in the figures is increased, the pressure drop is decreased, and the volume is increased.

Figure 8:
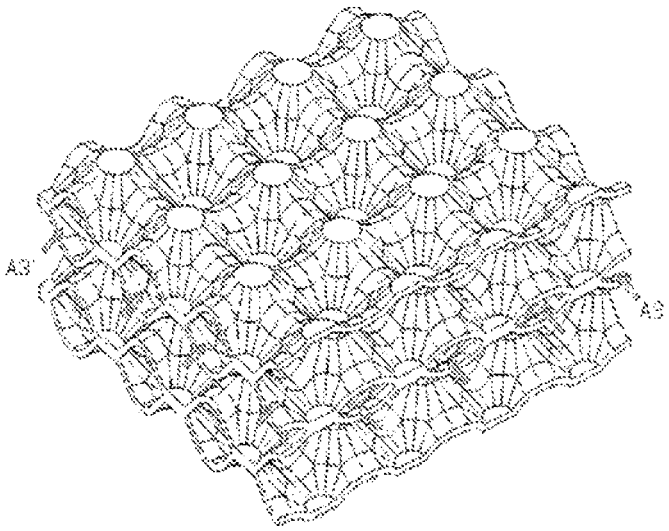
FIG. 8 is a three-dimensional schematic view of a part of a structure formed when four of the heat exchange plates shown in FIG. 2, after being adjusted, are stacked together to form heat exchange channels, according to another embodiment of the present invention, wherein the arrows in the drawing show the flow directions of fluids.
Figure 9B:
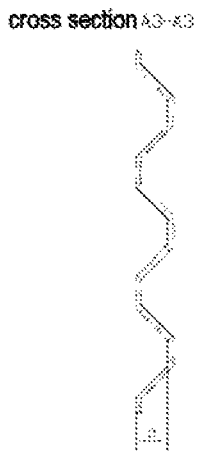
FIGS. 9*a*, 9*b*, 9*c* and 9*d* are a top view and cross sectional views along lines A3-A3, B3-B3 and C3-C3 respectively of a part of a first or upper heat exchange plate in FIG. 8.
Figure 9A:
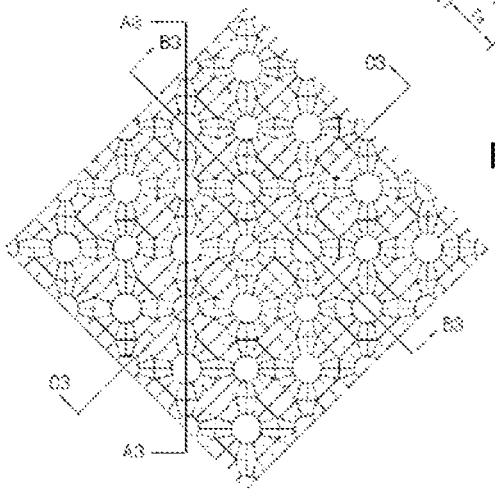
Figure 9C:
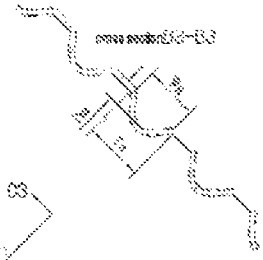
Figure 9D:
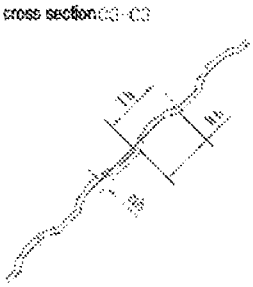

Next, taking FIGS. 8-9*d* as an example, the case where the parameter ha is increased while the parameter hb is decreased is taken as an example, such that a minimum flow cross section A3 of this plate surface of the heat exchange plate 20 shown in the figures is decreased, the pressure drop is increased and the volume is decreased.

As stated above, the step of adjusting the parameters Ha and Hb comprises: decreasing the parameter Ha while increasing the parameter Hb; or increasing the parameter Ha while decreasing the parameter Hb.

The parameters approximately satisfy the following relations:

$$Ha \approx \frac{Ta}{Ta+Tb} \times e, \quad Hb \approx \frac{Tb}{Ta+Tb} \times e.$$

Continuing to refer to FIGS. 6 and 8, a cross section profile and/or area of the heat exchange channel 26 between at least partial regions of the two adjacent heat exchange plates 20 is/are different on two adjacent sides of either one of the two heat exchange plates 20. Specifically, an arrangement is also possible whereby the heat exchange channel 26 between at least partial regions of the two adjacent heat exchange plates has a different minimum flow cross section profile and/or area on the two adjacent sides.

In a plate heat exchanger, different fluids flow through the heat exchange channels on two surfaces of the same heat exchange plate 20 in order to achieve heat exchange.

FIG. 6 shows that two sides of two heat exchange plates 20 which have been stacked together have two types of inlets for a first fluid and a second fluid, wherein a minimum flow cross section of the inlet of the heat exchange channel 26 on the right side is A2, and a minimum flow cross section of the inlet of the heat exchange channel 26 on the left side is A2'; clearly, relative to the minimum flow cross section A2, the other minimum flow cross section A2' has been decreased. Since the inlet of the heat exchange channel 26 is formed by cooperation of flow paths on two heat exchange plates 20, correspondingly, flow paths on two adjacent sides of at least partial regions of the heat exchange plates 26 have different minimum flow cross section profiles and/or areas.

By the same principle, FIG. 8 shows that two sides of two heat exchange plates 20 which have been stacked together have two types of inlets, wherein a minimum flow cross section of the inlet of the heat exchange channel 26 on the right side is A3, and a minimum flow cross section of the inlet of the heat exchange channel on the left side is A3'; clearly, relative to the minimum flow cross section A3, the other minimum flow cross section A3' has been increased. Since the inlet of the heat exchange channel 26 is formed by cooperation of flow paths on two heat exchange plates 20, correspondingly, flow paths on two adjacent sides of at least partial regions of the heat exchange plates 26 have different minimum flow cross section profiles and/or areas.

As stated above, the heat exchange plate and plate heat exchanger provided in the present invention can expand the flexibility of design of sheets of a dimple heat exchanger, such that the previous pressure drop range, heat exchange limitations and volume restrictions are overcome; the performance of the plate heat exchanger can be optimized without any increase in cost or processing difficulty; fluid distribution can be adjusted by adjusting transitional curved surfaces of different regions; and the transitional curved surfaces are controlled, to prevent variability in quality caused by the lack of control of transitional curved surfaces previously.

As is already known, the pressure drop, heat exchange performance and volume of a dimple heat exchanger are often determined by the distribution structure and depth of the dimples, and once these parameters have been defined, the pressure drop, volume and fluid distribution are fixed; the present invention, through the design described above, can change the voltage drop, volume and fluid distribution without changing the layout of dimples.

Furthermore, in the case of a dimple plate heat exchanger or a plate heat exchanger having a similar structure, transitions among dimples are often free transitions, i.e. the transitional curved surfaces among dimples are determined by the dimples and are unrestricted, but the pressure drop and volume of corrugations are significantly influenced by structure; the structural arrangement designed in the present invention can effectively solve this technical problem.

The above are merely some embodiments of the present invention. Those skilled in the art will understand that changes may be made to these embodiments without departing from the principles and spirit of the overall inventive concept. The scope of the present invention is defined by the claims and their equivalents.

What is claimed is:

1. A heat exchange plate, comprising depressions and protrusions, wherein flow paths on two adjacent sides of an at least partial region of the heat exchange plate have different minimum flow cross section areas, wherein a transitional curved surface between at least two adjacent depressions and/or protrusions on the at least partial region of the heat exchange plate defines the minimum flow cross section area of at least one of the flow paths;

wherein at least one of pressure drop, heat exchange performance and volume of an entire plate heat exchanger is/are set by means of at least one of the following parameters of the at least partial region of the heat exchange plate:

Ta: edge spacing between two adjacent protrusions or shortest distance between two adjacent protrusions on the heat exchange plate;

Tb: edge spacing between two adjacent depressions or shortest distance between two adjacent depressions, wherein a distance connecting line of said Tb and a distance connecting line of said Ta intersect with each other in space;

Ha: perpendicular distance between the highest point of the heat exchange plate and the lowest point of an upper surface of a depressed transitional curved line connected across Ta;

Hb: perpendicular distance between the lowest point of the heat exchange plate and the highest point of a lower surface of a protruding transitional curved line connected across Tb;

Wa: distance between two ends of the curved line corresponding to Ha; Wb: distance between two ends of the curved line corresponding to Hb;

e: perpendicular distance between the depression and a high point of an upper surface of the heat exchange plate, or perpendicular distance between the protrusion and the lowest point of a lower surface of the heat exchange plate;

wherein the parameters satisfy the following relations:

$$Ha \approx \frac{Ta}{Ta+Tb} \times e, \quad Hb \approx \frac{Tb}{Ta+Tb} \times e.$$

2. The heat exchange plate as claimed in claim 1, wherein a difference between Ha and Hb of the at least partial region, defines the pressure drop, heat exchange performance, volume and asymmetry of two sides of the heat exchange plate.

3. The heat exchange plate as claimed in claim 2, the difference between the parameters Ha and Hb is provided by setting the parameter Ha to be lower than the parameter Hb; or by setting the parameter Ha to be greater than the parameter Hb.

4. A plate heat exchanger, comprising multiple heat exchange plates stacked together, the heat exchange plates being heat exchange plates as claimed in claim 3, with a heat exchange channel being formed between two adjacent heat exchange plates after stacking.

5. The plate heat exchanger as claimed in claim 4, wherein different fluids flow through flow paths on two surfaces of the same heat exchange plate in order to achieve heat exchange.

6. A plate heat exchanger, comprising multiple heat exchange plates stacked together, the heat exchange plates being heat exchange plates as claimed in claim 2, with a heat exchange channel being formed between two adjacent heat exchange plates after stacking.

7. The plate heat exchanger as claimed in claim 6, wherein different fluids flow through flow paths on two surfaces of the same heat exchange plate in order to achieve heat exchange.

8. A plate heat exchanger, comprising multiple heat exchange plates stacked together, the heat exchange plates being heat exchange plates as claimed in claim 1, with a heat exchange channel being formed between two adjacent heat exchange plates after stacking.

9. The plate heat exchanger as claimed in claim 8, wherein different fluids flow through flow paths on two surfaces of the same heat exchange plate in order to achieve heat exchange.

* * * * *